US007322740B2

(12) United States Patent
Heusser et al.

(10) Patent No.: US 7,322,740 B2
(45) Date of Patent: Jan. 29, 2008

(54) STATIC MIXER FOR A CURING MIXED PRODUCT

(75) Inventors: Rolf Heusser, Winterthur (CH); Sandro Martino, Winterthur (CH)

(73) Assignee: Sulzer Chemtech AG, Winterthur (CH)

( * ) Notice: Subject to any disclaimer, the term of this patent is extended or adjusted under 35 U.S.C. 154(b) by 416 days.

(21) Appl. No.: 11/113,522

(22) Filed: Apr. 25, 2005

(65) Prior Publication Data

US 2005/0237856 A1 Oct. 27, 2005

(30) Foreign Application Priority Data

Apr. 22, 2004 (EP) ..... 04405246

(51) Int. Cl.
*B01F 5/06* (2006.01)

(52) U.S. Cl. ..... 366/337; 366/338

(58) Field of Classification Search ..... 366/336, 366/337, 338, 340

See application file for complete search history.

(56) References Cited

U.S. PATENT DOCUMENTS

| | | | | |
|---|---|---|---|---|
| 3,239,197 | A * | 3/1966 | Tollar | 366/337 |
| 3,328,003 | A | 6/1967 | Chisholm | |
| 3,852,013 | A * | 12/1974 | Upmeier | 366/340 |
| 4,179,222 | A * | 12/1979 | Strom et al. | 366/337 |
| 4,793,247 | A * | 12/1988 | Verweij | 366/338 |
| 4,850,705 | A | 7/1989 | Horner | |
| 5,851,067 | A | 12/1998 | Fleischli et al. | |
| 5,944,419 | A | 8/1999 | Streiff | |
| 2003/0048694 | A1 | 3/2003 | Horner et al. | |

FOREIGN PATENT DOCUMENTS

CH 376476 4/1964

OTHER PUBLICATIONS

Schneider G: "Les Melangeurs Statiques Dans La Transfomation Des Matieres Thermodurcissables Et Thermoplastiques" Revue Technique Sulzer, Sulzer Freres S.A. Winterthur, Ch, Bd. 70, Nr. 4, 1988, Seiten 31-36, XP000023729, Date:1998.

(Continued)

*Primary Examiner*—Tony G Soohoo
(74) *Attorney, Agent, or Firm*—Francis C. Hand; Carella, Byrne, Bain et al.

(57) ABSTRACT

The static mixer is used for a curing mixed product of flowable components that react to form a solidifying mass on mixing. The mixer has mixing chambers that are arranged behind one another and next to one another along a tube axis. Each mixing chamber is delineated by longitudinal walls oriented in the direction of the tube axis and by transverse walls standing transversely to the tube axis. Openings in the longitudinal walls and in the floor of each mixing chamber establish inlets and outlets for the mixed product. The corner of at least some of the mixing chambers upstream of an outlet in the longitudinal walls is filled in to form a concave surface for directing the flowable components towards the outlet. The transverse wall at an inlet to at least some of the mixing chambers is also formed with a concave surface for directing the flowable components through the inlet into the mixing chamber.

13 Claims, 3 Drawing Sheets

OTHER PUBLICATIONS

Schmidt A: "Gut Gemischt" Kunststoffe, Carl Hanser Verl. Munich, De, Bd. 94, Nr. 2, 2004, Seiten 44-46, XP001046714 ISSN: 0023-5563, 3 pgs, date:Feb. 2004.

Michel O: "Statische Mischer In Der Kunststofftechnik", Kunststoffe, Carl Hanser Verl. Munich, De, Bd. 92, Nr. 7, 2002, Seiten 80-81, XP001124004 ISSN: 0023-5563, 2 pgs, date:2002.

Zalc J M Et Al: "Mixing Dynamics In The SMX Mixer As A Function Of Injection Location And Flow Ratio" Polymer Engineering & Science, Wiley & Sons, Bognor Regis, GB, Bd. 43, Nr. 4, Apr. 2003, Seiten 875-890, XP001145137 ISSN: 0032-3888, 16 pgs, date:2003.

* cited by examiner

STATIC MIXER FOR A CURING MIXED PRODUCT

BACKGROUND OF THE INVENTION

This invention relates to a static mixer for mixing at least two flowable components that react on mixing to form a solidified mass.

Static mixers for the mixing of at least two flowable components are described in EP-A-0 749 776 and EP-A-0 815 929. These mixers, which are compact, deliver good mixing results, despite a simple material-saving design, and particularly in the mixing of high-viscosity substances such as sealants, two-component foams or two-components adhesives. The installed elements forming the mixer structure can be manufactured at a favorable cost by injection molding from thermoplastics so that they can be used economically for one-time use. Such a "disposable mixer" is mainly used for curing products, since the mixers can not be practically cleaned with these products.

Even if the mixing of a curing mixed product with a disposable mixer is operated continuously or quasi-continuously (for example in cycles), finite useful lives, however, result. With a continuous carrying out of the mixing under an extruding pressure that remains largely constant, i.e. with a pressure drop along the installed elements of the mixer, for example, the discharge of the mixing product noticeably reduces according to the service life. That is to say, as the service life increases, the output of the mixer decreases due to an increasing pressure drop within the mixer.

An increase in the extruding pressure only allows a relatively short extension of the mixed product discharge.

SUMMARY OF THE INVENTION

Accordingly, it is an object of the invention to provide an improved mixer for mixing at least two flowable components that react on mixing to form a solidified mass.

It is another object of the invention to increase the service life of a mixer for mixing at least two flowable components.

Briefly, the invention provides a static mixer for a curing mixed product of flowable components that react to form a solidifying mass on mixing.

The mixer includes an element that is manufactured by injection moulding and a tube for encasing the element.

The element includes a pair of parallel longitudinally disposed outer walls parallel to the longitudinal axis of the tube; a plurality of longitudinally spaced apart intermediate walls between the pair of outer walls and parallel to the longitudinal axis of the tube; a plurality of transverse walls, each transverse wall being secured to and extending between a respective one of the outer walls and a respective one of the intermediate walls; and a plurality of longitudinally spaced apart webs or floors, each web being secured to and extending perpendicularly between the outer walls.

The element has a plurality of mixing chambers disposed in rows longitudinally of the longitudinal axis of the tube and laterally of each other for receiving and mixing at least two flowable components therein. Each mixing chamber is disposed between a respective one of the outer walls, a pair of consecutively disposed transverse walls in a respective row, a pair of consecutively disposed intermediate walls and a pair of consecutively disposed webs in the respective row.

In addition, each pair of consecutively disposed intermediate walls defines a first inlet to a mixing chamber and a first outlet from the chamber and one of webs defines a second inlet to a mixing chamber with one of the transverse walls and a second outlet from the chamber with the other of the webs.

In accordance with the invention, at least one of the mixing chambers has a first corner filling forming a concave surface between one of the outer walls and one of the transverse walls for directing the flowable components towards the first outlet.

Here, the term "concave surface" means a surface which is not arched toward the interior space of the mixing chamber at any point. The surface can also be planar regionally. The concave surface is concavely curved or forms, together with the flanks of the corner of the mixing chamber, a "concave segment" in cross-section which approximately has the extent of a concavely curved curve. A small wedge-shaped corner filling provides an example for a concave surface in the sense of a secondary meaning.

At least one of the mixing chambers also has a second corner filling forming a concave surface on one of the transverse walls for directing the flowable components from the second inlet into the mixing chamber. Also, the corner fillings in one mixing chamber may be of a different size from the corner fillings in an adjacent mixing chamber.

Preferably, each of the corner fillings merges into a planar surface on the associated transverse wall in a middle third thereof.

A static mixer is known from US-A-2004/0008576 whose installed element is similar to that of the mixer in accordance with the invention, but with the corresponding corner fillings being wedge-shaped and not concave in the sense of the meaning defined above. The shape of these corner fillings is less favourable with respect to an extension of the service life. There is also a disadvantage in that the wedge-shaped corner fillings mean relatively large aggregations of wall material. Such material aggregations are unfavourable in the injection moulding of the installed element since they result in longer production cycles and thus higher manufacturing costs.

These and other objects and advantages of the invention will become more apparent from the following detailed description taken in conjunction with the accompanying drawings wherein:

DETAILED DESCRIPITON OF A PREFFERED EMBODIMENT

Figure 1:
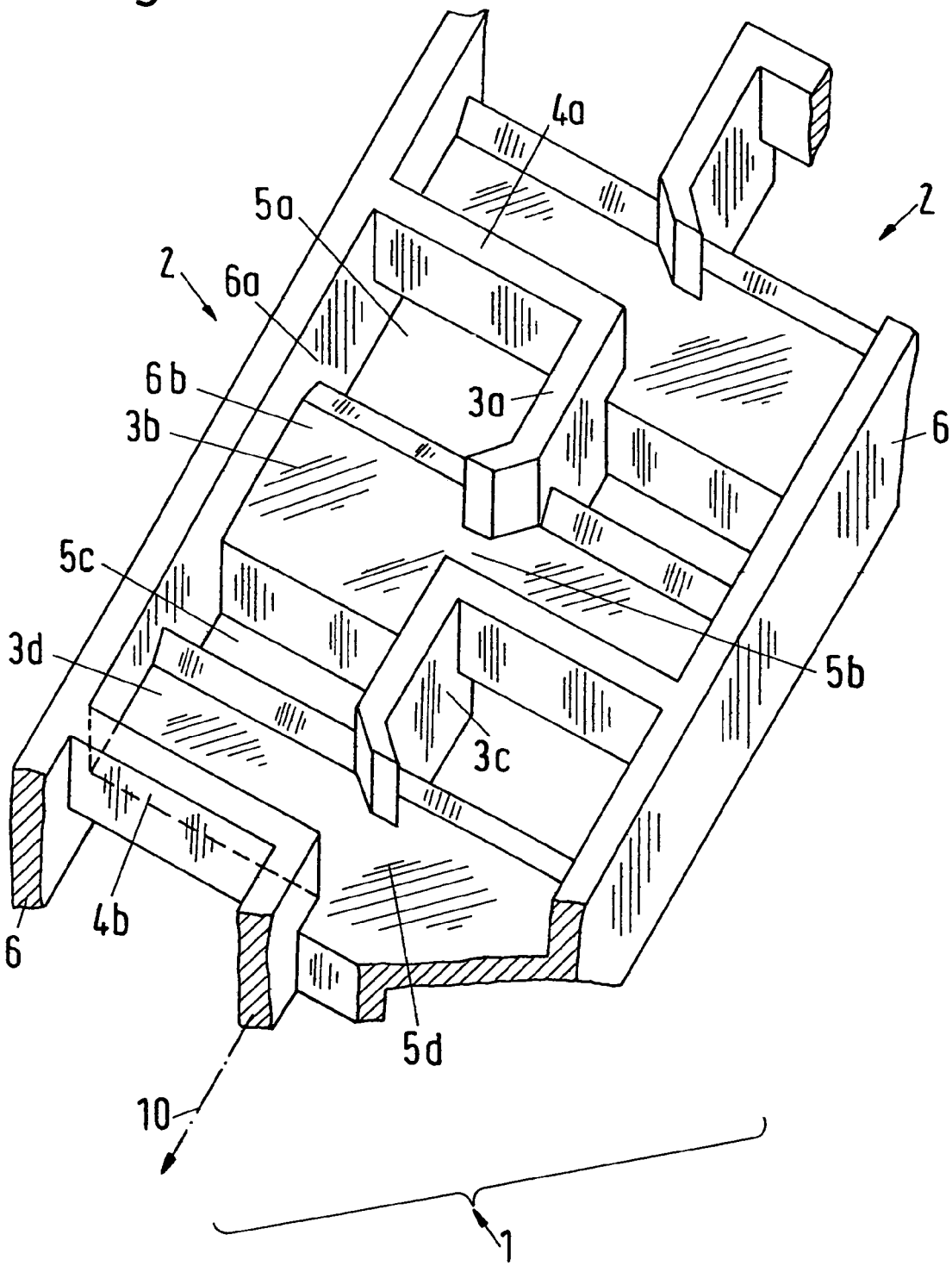
FIG. 1 illustrates a perspective view of an element for a static mixer of known construction.

Referring to FIG. 1, the mixer element 1 of a disposable mixer is known from EP-A-0 749 776 and is manufactured by injection moulding for insertion inserted into a tube (not shown). This tube encasing the installed element 1 has an interior space with a square cross-section into which the installed element 1 fits with shape matching along a longitudinal axis 10 of the tube. (The installed element 1 and the encasing tube could also be made cylindrically: cf. FIG. 3).

Flowable components of a curing mixed product are forced through the tube and the installed element 1 from cartridges by means of pistons, with the reactive mixed product components being mixed to form a solidifying mass.

The installed element 1 has a chamber arrangement of a plurality of mixing chambers 2. The mixing chambers 2 are arranged in rows one behind the other and next to one another along the longitudinal tube axis 10 for receiving and mixing at least two flowable components therein.

Each mixing chamber 2 is delineated by a pair of parallel longitudinally disposed outer walls 6 parallel to the longitudinal axis 10, a pair of longitudinally spaced apart intermediate walls 3*a*,3*c* between the pair of outer walls 6 and parallel to the longitudinal axis 10, a pair of transverse walls 4*a*,4*b* each of which is secured to and extends between a respective one of the outer walls 6 and a respective one of the intermediate walls 3*a*,3*b*, and a pair of longitudinally spaced apart webs 3*b*,3*d*, each of which is secured to and extends perpendicularly between the outer walls 6.

Each pair of consecutively disposed intermediate walls 3*a*,3*c* defines a first inlet 5*b* to the mixing chamber 2 and a first outlet 5*d* from the chamber. One of webs 3*b* defines a second inlet 5*a* to the chamber 2 with one of the transverse walls 4*a* and a second outlet 5*c* from the chamber 2 with the other of the webs 3*d*.

Figure 2:
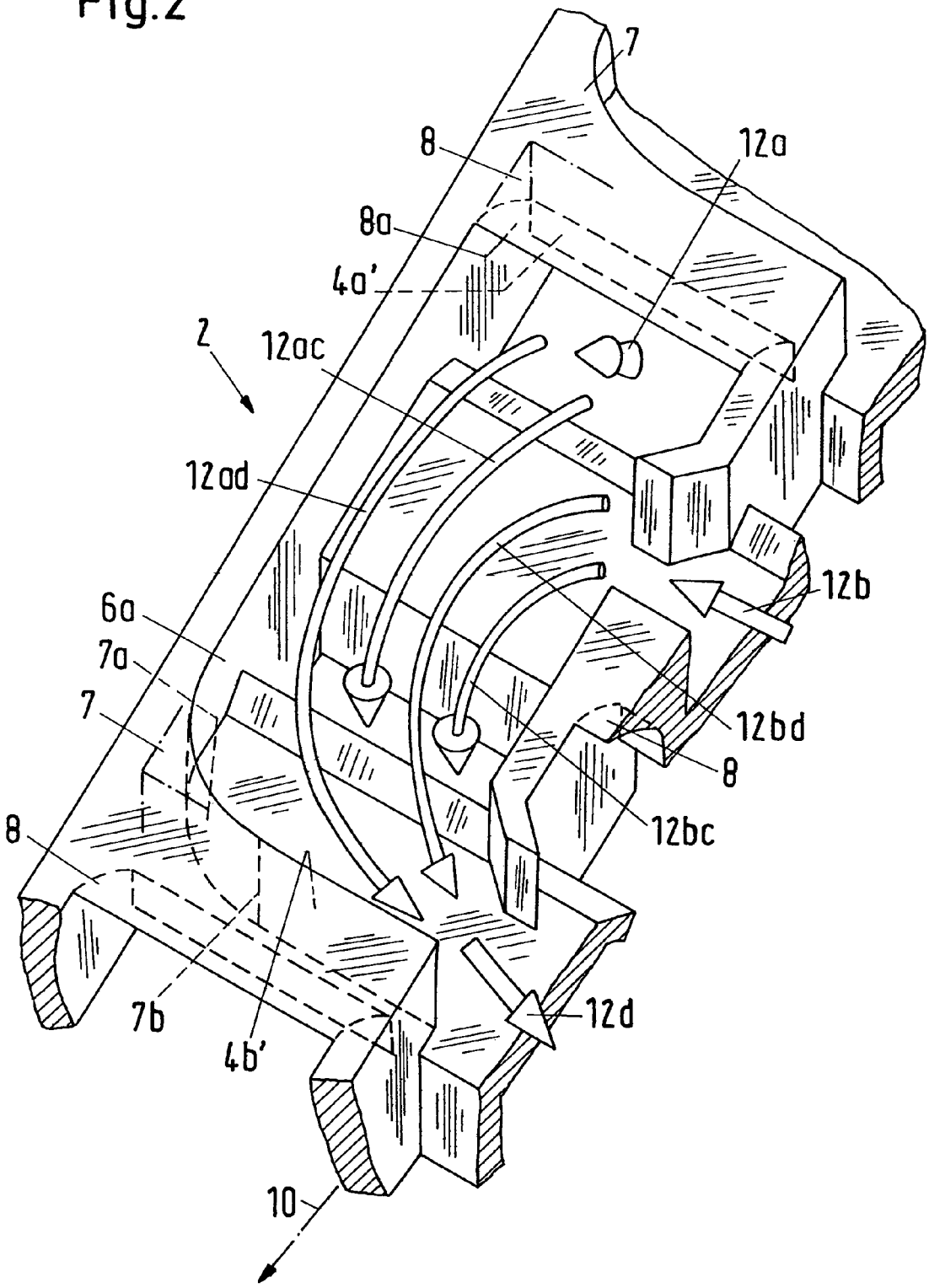
FIG. 2 illustrates a part perspective view of a portion of an element for a static mixer in accordance with the invention.

Referring to FIG. 2, wherein like reference characters indicate like parts as above, the transport of the mixed product through the mixing chamber 2 is shown with arrows. The inlet 5*a*, through which a flow 12*a* of the mixed product enters, is located at the inlet side directly by the transverse wall 4*a* (see FIG. 1). The flow 12*a* branches into part flows 12*ad* and 12*ac* that flow off into adjacent mixing chambers through the outlets 5*d* and 5*c*.

A flow 12*b* enters through the second inlet 5*b* and is accordingly branched into part flows 12*bd* and 12*bc* which exit the mixing chamber 2 together with the part flows 12*ad* and 12*ac*.

A field of pressure gradients is created in the mixing chamber 2 on the extruding of the mixed product through the installed element 1. A velocity field of the mixed product flow is formed in accordance with the pressure gradients. The pressure gradients are the most pronounced in the region of the openings 5*a*, 5*b*, 5*c* and 5*d*, where the flow speeds are also the highest. The flow can be thought of as a bundle of flow threads. The cross-sections of the flow threads inside the mixing chamber 2 widen and, consequently, relatively low flow speeds occur there. The pressure gradients are also reduced accordingly. The reduction of the pressure gradients is location-dependent. The pressure gradients are in particular very low in corner regions that lie at a larger distance from the openings 5*a*, 5*b*, 5*c* and 5*d*. The pressure gradients practically disappear there so that the mixed product flows very slowly and practically stagnates. A reaction occurs between the mixed product components in mixing chambers in which the mixing has already progressed to a large degree. This results in an increase in the viscosity of the mixed product in the regions with a stagnating flow.

The stagnating regions increase due to this change of the viscosity so that a local immobilisation inexorably occurs. This immobilisation starts in these corner regions and expands from there into the interior region of the mixing chamber 2. The flow resistance of the installed elements 1 thereby increases. The mixing quality is also simultaneously impaired.

The fact is associated with the occurrence of the immobilisation that the mixing with the disposable mixer can only be carried out during a service life that depends on the reaction kinetics of the curing mixed product. The service life can be increased when measures are taken against the stagnation in the flowing mixed product.

Referring to FIG. 2, in accordance with the invention, the mixing chamber 2 is provided with a first corner filling 7 forming a concave surface 7*a* between one of the outer walls 6 and one of the transverse walls 4*b'* for directing the flowable components towards the outlet 5*d*. As indicated, the corner is filled with wall material, indicated as a "tripod" drawn with a chain-dotted line by the transverse wall 4*b*. The filling of this corner, which is termed a "first corner filling 7", sets up a concave surface 7*a* (in accordance with the meaning recited above) with respect to the interior space of the mixing chamber 2. As becomes vividly clear from FIG. 2, the conditions for the occurrence of stagnation are eased by the first corner filling 7, which brings about an extension of the service life.

A further measure in the form of a "second corner filling 8" additionally contributes to an extension of the service life. As shown, the transverse wall 4*a* is filled with wall material opposite the web 6*b* to form the second corner filling 8 with a concave surface 8*a* facing the interior space of the mixing chamber 2. The action of this second corner filling 8 is the same as that of the first corner filling 7.

The immobilisation comes into effect the more strongly, the further a mixing chamber 2 lies downstream—as long as no measure, or the same measure everywhere, is taken against this problem. It is therefore of advantage for the first and/or second corner fillings 7, 8 to be made at least partly of different size and for each corner filling 7 or 8 to be equally as large as or smaller than the corner fillings 7 or 8 following downstream.

The corner fillings 7, 8 should not form material aggregations that are too large, for which reasons were already given above. It is therefore advantageous if the following applies to the first corner filling 7 (and accordingly to the second corner filling 8): the concave surfaces 7*a* (or 8*a*) each merge at an interface line 7*b* into a planar surface part 4*b'* (or 4*a*') of the transverse wall 4*b* (or 4*a*). This interface line 7*b* should lie in a middle strip of the transverse wall 4*b*, with this strip occupying the middle third of the transverse wall 4*b* at its inner side.

The concave surfaces 7*a* or 8*a* are each at least approximately part of a circular cylinder. The axis of this cylinder lies in a plane standing perpendicular to the tube axis 10. The cylinder axes associated with the two corner fillings 7 and 8 are aligned perpendicular to one another.

The concave surfaces 7*a* and 8*a* each merge with a smooth course into planar surface parts 4*a'* or 4*b'* of the transverse walls 4*a* or 4*b*. The same applies to transitions in planes on which the outer sides 6*a* or 6*b* of the mixing chamber 2 lie.

The web 6*b* of the mixing chamber 2 is covered by the second corner filling 8 in the region of a zone whose area is no larger than the opening area of the inlet 5*a* bordering on the transverse wall 4*a*. This condition results from the geometry of the tool used as the mold in the injection mold device.

Figure 3:
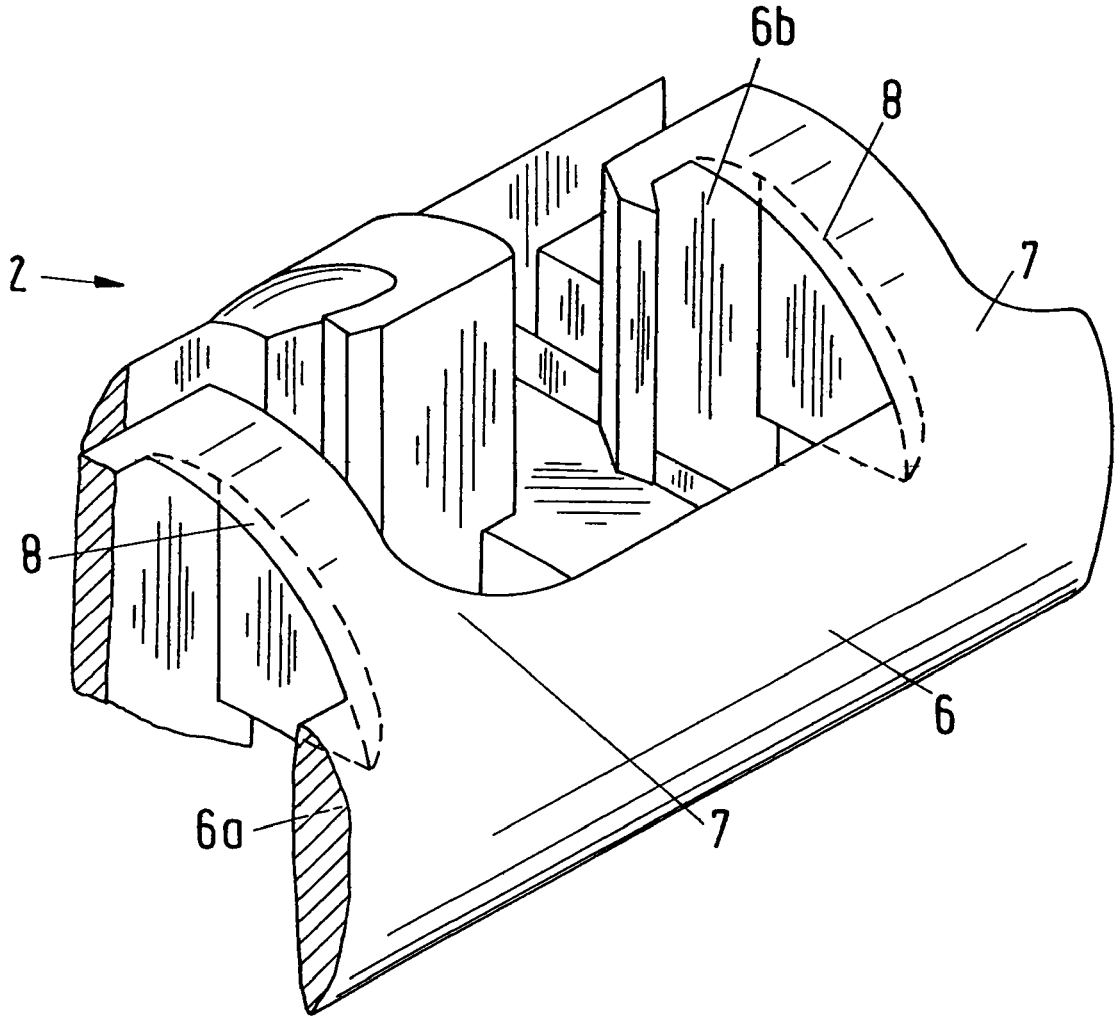
FIG. 3 illustrates a part perspective view of a cylindrical mixer element in accordance with the invention.

Referring to FIG. 3, wherein like reference characters indicate like parts as above, the mixer element may be of cylindrical shape to fit within a tube of cylindrical shape. As above the element has first and second corner fillings 7 and 8. The outer longitudinal walls 6, which form the first outer sides 6*a* of the mixing chambers, have a circular segment-like cross-section. The web 6*b* is curved. The one flank of the second corner filling 8 is therefore also curved accordingly.

When using the mixer in accordance with the invention, the mixed product of components that react to form a solidifying mass on mixing is advantageously mixed continuously or quasi-continuously with an extruding pressure that remains largely constant or varies in cycles, i.e. with a pressure drop along the installed elements 1 of the mixer. The mixing is interrupted and the mixer replaced as soon as a discharge of mixed product becomes noticeably smaller or an increase of the extruding pressure becomes necessary.

The element 1 may be constructed without the outer longitudinal walls 6 in which case the walls of the tube would take the place of the walls 6 of the element 1.

The invention thus provides an element for a static mixer that mixes at least two flowable components that react on mixing to form a solidified mass that is capable of a relatively long service life.

What is claimed is:

1. An element for mounting in a tube having a longitudinal axis for mixing at least two flowable components that react on mixing to form a solidified mass, said element comprising a pair of parallel longitudinally disposed outer walls parallel to said longitudinal axis;

a plurality of longitudinally spaced apart intermediate walls between said pair of outer walls and parallel to said longitudinal axis;

a plurality of transverse walls, each said transverse wall secured to and extending between a respective one of said outer walls and a respective one of said intermediate walls;

a plurality of longitudinally spaced apart webs, each said web secured to and extending perpendicularly between said outer walls;

a plurality of mixing chambers disposed in rows longitudinally of said longitudinal axis and laterally of each other for receiving and mixing at least two flowable components therein;

each said mixing chamber being disposed between a respective one of said outer walls, a pair of consecutively disposed transverse walls in a respective row, a pair of consecutively disposed intermediate walls and a pair of consecutively disposed webs in said respective row, said pair of consecutively disposed intermediate walls defining a first inlet to said chamber and a first outlet from said chamber and one of said webs defining a second inlet to said chamber with one of said transverse walls and a second outlet from said chamber with the other of said webs; and at least one of said mixing chambers having a first corner filling forming a concave surface between one of said outer walls and one of said transverse walls for directing the flowable components towards said first outlet.

2. An element as set forth in claim 1 wherein said first corner filling merges into a planar surface on said one of said transverse walls in a middle third thereof.

3. An element as set forth in claim 2 wherein said first corner filling merges into a planar surface on said one of said outer walls.

4. An element as set forth in claim 2 wherein said concave surface is part of a circular cylinder having an axis in a plane perpendicular to said longitudinal axis.

5. An element as set forth in claim 1 wherein said first corner filling in each said mixing chamber is of a different size from a first corner filling in an adjacent mixing chamber.

6. An element as set forth in claim 1 characterized in having one of a rectangular and a circular cross-section.

7. An element as set forth in claim 1 wherein at least one of said mixing chambers has a second corner filling forming a concave surface on one of said transverse walls for directing the flowable components from said second inlet into said chamber.

8. An element as set forth in claim 7 wherein said second corner filling merges into a planar surface on said one of said transverse walls in a middle third thereof.

9. An element as set forth in claim 8 wherein said concave surface of said second corner filling is part of a circular cylinder having an axis in a plane perpendicular to said longitudinal axis.

10. An element as set forth in claim 7 wherein said second corner filling in each said mixing chamber is of a different size from a second corner filling in an adjacent mixing chamber.

11. A static mixer comprising a tube having a longitudinal axis, and an element disposed in said tube for mixing at least two flowable components, said element comprising a plurality of longitudinally spaced apart intermediate walls parallel to said longitudinal axis;

a plurality of transverse walls, each said transverse wall secured to and extending from a respective one of said intermediate walls;

a plurality of longitudinally spaced apart webs, each said web secured to and extending perpendicularly of a pair of said intermediate walls;

a plurality of mixing chambers disposed in rows longitudinally of said longitudinal axis and laterally of each other for receiving and mixing at least two flowable components therein;

each said mixing chamber being disposed between one side of said tube, a pair of consecutively disposed transverse walls in a respective row, a pair of consecutively disposed intermediate walls and a pair of consecutively disposed webs in said respective row, said pair of consecutively disposed intermediate walls defining a first inlet to said chamber and a first outlet from said chamber and one of said webs defining a second inlet to said chamber with one of said transverse walls and a second outlet from said chamber with the other of said webs; and at least one of each said mixing chambers having a first corner filling forming a concave surface between said side of said tube and one of said transverse walls for directing the flowable components towards said first outlet.

12. A static mixer as set forth in claim 11 wherein at least one of said mixing chambers has a second corner filling forming a concave surface on one of said transverse walls for directing the flowable components from said second inlet into said chamber.

13. A static mixer as set forth in claim 11 wherein said tube has one of a rectangular and a circular cross-section.

* * * * *